US006290114B1

(12) United States Patent
Berberian

(10) Patent No.: US 6,290,114 B1
(45) Date of Patent: Sep. 18, 2001

(54) BACK PACK FOR USE WITH HUNTING BOW AND METHOD

(75) Inventor: Nick O. Berberian, Van Nuys, CA (US)

(73) Assignee: BBC MFG, South El Monte, CA (US)

( * ) Notice: Subject to any disclaimer, the term of this patent is extended or adjusted under 35 U.S.C. 154(b) by 0 days.

(21) Appl. No.: 09/549,418

(22) Filed: Apr. 13, 2000

(51) Int. Cl.[7] ..... A45F 3/04

(52) U.S. Cl. ..... 224/642; 224/637; 224/653; 224/659; 224/916

(58) Field of Search ..... 224/916, 637, 224/642, 653, 657, 659, 655

(56) References Cited

U.S. PATENT DOCUMENTS

| | | | | |
|---|---|---|---|---|
| 2,324,194 | * | 7/1943 | Campiglia | 224/657 |
| 3,622,056 | * | 11/1971 | Droeger | 224/653 |
| 4,480,774 | * | 11/1984 | Smith et al. | 224/916 |
| 4,648,121 | * | 3/1987 | Lowe | 224/259 |
| 4,883,207 | * | 11/1989 | McArthur | 224/153 |
| 5,209,384 | * | 5/1993 | Anderson | 224/209 |
| 5,439,154 | * | 8/1995 | Delligatti | 224/205 |
| 5,465,887 | * | 11/1995 | Hudson | 224/209 |
| 5,779,112 | * | 7/1998 | Krulik | 224/155 |
| 5,791,537 | * | 8/1998 | Miller | 224/583 |
| 5,893,495 | * | 4/1999 | Godshaw et al. | 224/153 |
| 5,950,896 | * | 9/1999 | Theodore | 224/647 |
| 5,961,017 | * | 10/1999 | Mehler | 224/576 |
| 5,975,393 | * | 11/1999 | Bellamy | 224/655 |
| 5,984,154 | * | 11/1999 | Scicluna | 224/153 |

* cited by examiner

*Primary Examiner*—Stephen P. Garbe
(74) *Attorney, Agent, or Firm*—Lewis, D'Amato, Brisbois & Bisgaar LLP

(57) ABSTRACT

A back pack for use with a hunting bow typically employed by a hunter in pursuit of game in the bush includes an outer shell having a spacious enclosed compartment for holding hunting gear. The outer shell includes a pair of shoulder straps for carrying the pack on the hunters back. The back pack includes at least a first securing strap for retaining a hunting bow to the back pack. A bow pouch is also included for supporting the bottom end of the hunting bow and a cushioned flap attached to the outer shell is included for covering and protecting the hunting bow. In its most fundamental embodiment, the back pack for use with a hunting bow exhibits a construction including an outer shell having a front surface and a rear surface for forming an enclosed compartment. The enclosed compartment is readily accessible to the hunter. A pair of shoulder straps are attached to the rear surface of the outer shell for carrying the back pack. A first securing strap is attached to the front surface of the outer shell for retaining a hunting bow to the back pack. Finally, a cushioned flap hinged to a first edge of the front surface of the outer shell is employed for covering and protecting the hunting bow.

20 Claims, 12 Drawing Sheets

FIG. 4
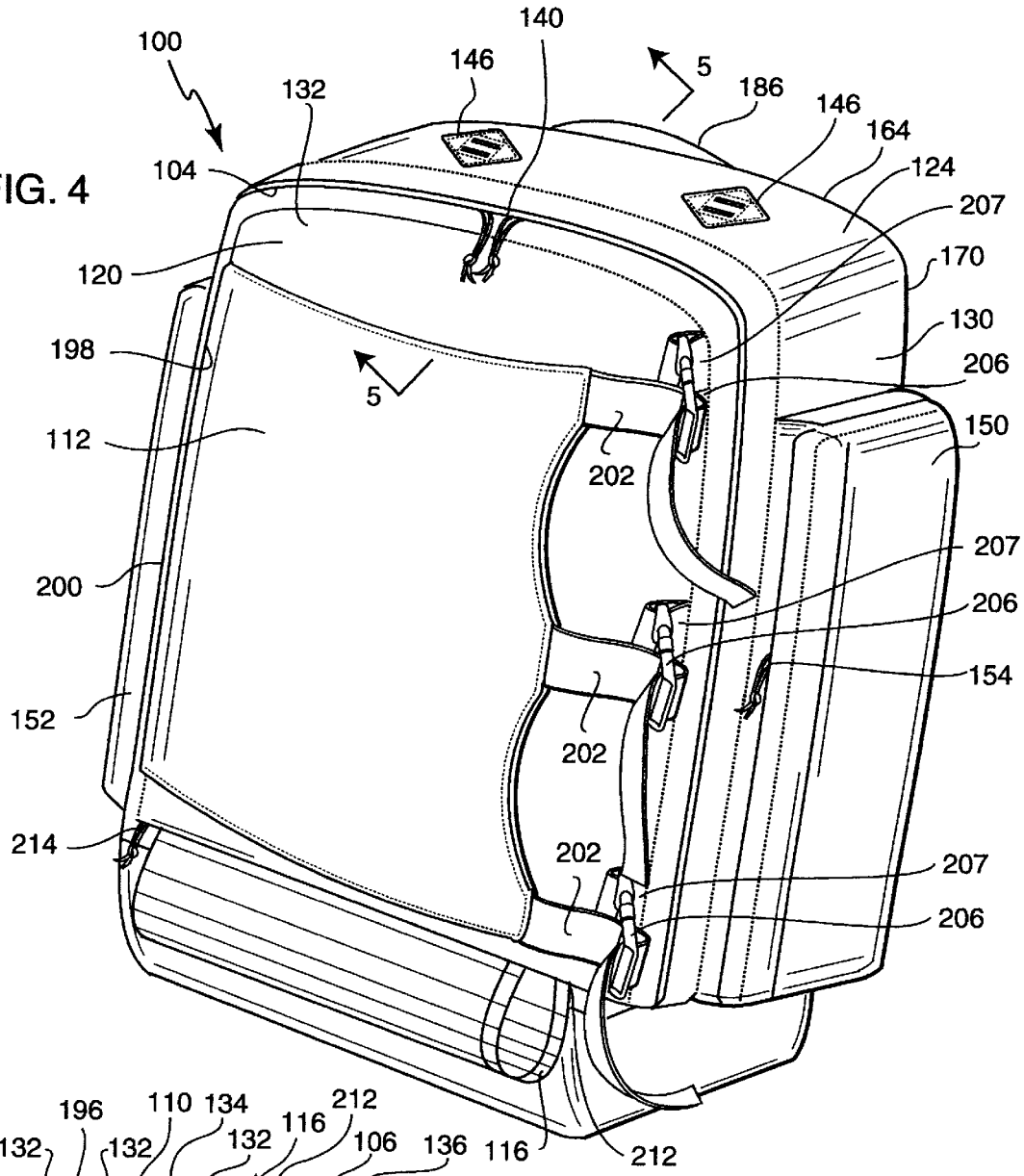
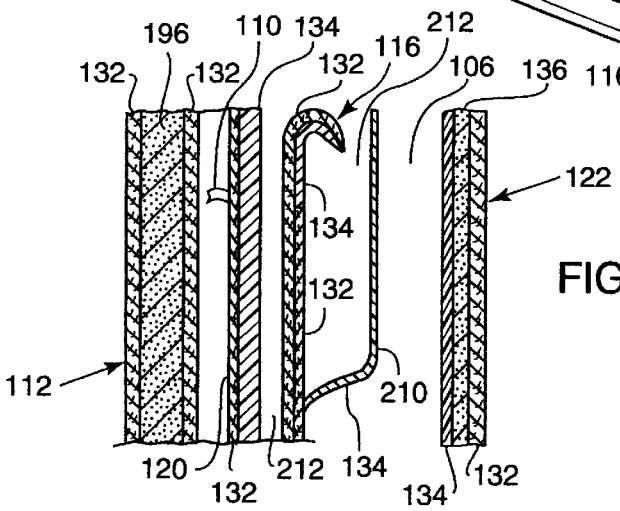
FIG. 5

BACK PACK FOR USE WITH HUNTING BOW AND METHOD

BACKGROUND OF THE INVENTION

1. Field of the Invention

The present invention relates to hunting equipment. More specifically, the present invention relates to methods and apparatus for a back pack designed specifically for use with a hunting bow intended for hunting game and having at least one adjustable securing strap and a separate bow pouch for securely carrying a hunting bow and arrows, and a cushioned flap used for protecting a sighting device typically fitted on high quality hunting bows.

2. Description of the Prior Art

The prior art is directed to methods and apparatus for back packs typically employed during hunting of game in the wild.

One of the early forms of hunting game know to man involves the use of a bow and arrow. While many hunters prefer to utilize firearms, a corp of hunters continue to employ the bow and arrow while stocking prey. Early hunters utilized a bow having a crude construction and typically carried the bow and arrows in their hands. As time progressed, the hunter's placed their head and one shoulder through the bow so the bow could be carried across the back. Arrows were placed within a cylindrical shaped carrying case or container known as a quiver typically fashioned from animal skins. The quiver was also carried across the hunter's back. Any provisions or hunting gear might be carried in a container formed from animal skins.

Over time, the construction of bows and arrows became more sophisticated. For example, the bows were comprised of high quality wood construction where the wood was selected for its strength and flexibility. The bow string was no longer formed from strands of animal skins but were formed of high strength cord. Likewise, provisions and hunting gear continued to be carried in leather packs carried across the shoulder or on the back of the hunter.

Modern hunting bows are now often comprised of high strength fiber glass formed in such a shape as to increase the resiliency of the bow. The bow strings are now comprised of very strong synthetic materials such as nylon which provide long service before they must be replaced. Although quivers for holding arrows and comprised of a leather, canvas or synthetic case are still utilized, other devices are also used for holding arrows. An example includes a planar device that is removably attached directly to the hunting bow upon which a plurality of arrows can be carried.

Simultaneously, many types of back packs comprised of leather, canvas and synthetic materials and intended for carrying hunting gear, clothing, provisions, first aid, and other types of equipment are now available. Notwithstanding these advances, the lack of any alternatives continues to require bow hunters to carry their hunting bow in their hands. When traveling into the bush for the purpose of stocking prey, hunters often travel by conventional means such as automobile. However, once the boundary of the hunting reserve is reached, hunters typically hike into the hunting region. Carrying ones hunting bow by hand can be clumsy, particularly when the hunter is simultaneously handling other equipment and/or climbing up and down hills in search of game.

In the past, hunters would physically tie or lash their hunting bow to the back side of a back pack in order to free their hands for performing other tasks. Generally, back packs were not designed to accommodate the hunting bows. Thus, if a hunting bow was lashed to a back pack, it tended to get caught in the thicket during the hike. This result tended to slow the advance of the hunters and to frustrate the search for prey. Further, most back packs of the prior art were comprised of a material, the movement of which tended to generate noise. The increased noise factor often would alert the prey and further frustrate the search therefore.

Thus, there is a need in the art for a back pack for use with a hunting bow which includes an outer shell that forms an enclosed compartment that is accessible via a mechanical closure and has adjustable shoulder straps, and which includes at least a first securing strap affixed to the outer shell for attaching a hunting bow to the back pack, a bow pouch extending downward from said outer shell for supporting a bottom end of the hunting bow, and a cushioned flap hinged to the outer shell for covering and protecting the hunting bow.

SUMMARY OF THE INVENTION

Briefly, and in general terms, the present invention provides a new and improved back pack and method therefore which is typically employed with a hunting bow used by hunters in the bush. Generally, the back pack for use with a hunting bow is comprised of an outer shell having a spacious enclosed compartment for holding hunting gear. The outer shell includes a pair of shoulder straps for carrying the pack on the hunters back. The back pack includes at least a first securing strap for retaining a hunting bow to the back pack. A bow pouch is also included for supporting the bottom end of the hunting bow and a cushioned flap attached to the outer shell is included for covering and protecting the hunting bow.

In a preferred embodiment, the back pack for use with a hunting bow includes an outer shell having a generally rectangular construction and a spacious enclosed compartment. The enclosed compartment is accessible from the top of the outer shell via a heavy duty mechanical zipper-type closure. The outer shell has a front surface and a rear surface. The pair of shoulder straps are attached to the rear surface of the outer shell and are cushioned to provide comfort to the hunter. The first securing strap is attached to the upper portion of the front surface of the outer shell and is typically comprised of an adjustable web belt. The first securing strap is utilized by the hunter to lash or secure the hunting bow to the front surface of the back pack. A cushioned flap attached to the front surface of the back pack is enabled to hinge so as to cover and protect the hunting bow. The cushioned flap is attachable to the front surface of the outer shell by a plurality of quick release mechanical clips.

A second securing strap, if fitted, is typically attached to the bottom portion of the front surface of the outer shell and is also utilized for lashing or securing the hunting bow to the front surface of the back pack. If the second securing strap is fitted and utilized, the cushioned flap is then hinged over the hunting bow that is secured by both the first and second securing straps. The use of two securing straps further stabilizes the hunting bow to the front surface of the outer shell. The bow pouch is connected to and extends downward from the outer shell and includes a pocket or pouch for capturing and supporting the bottom end of the hunting bow. The bow pouch is employed in conjunction with the first and second securing straps for retaining the hunting bow to the back pack. A storage space is formed between the front surface of the back pack and the enclosed compartment for stowing the bow pouch when not in use.

The present invention is generally directed to a back pack and particularly directed to a back pack for use with a hunting bow. In addition to the spacious enclosed compartment typically used for stowing hunting gear, provisions and clothing, the back pack of the present invention also includes at least one side storage pocket, but more typically two. However, in a preferred embodiment, the back pack of the present invention may include a quiver attached thereto for carrying arrows. The back pack also includes a waist belt for securing the back pack around the waist of the hunter and a plurality of anchor loops for enabling miscellaneous items such as a blanket, ground pad or tarp to be lashed thereto.

In its most fundamental embodiment, the back pack for use with a hunting bow exhibits a construction including an outer shell having a front surface and a rear surface for forming an enclosed compartment. The enclosed compartment is readily accessible to the hunter. A pair of shoulder straps are attached to the rear surface of the outer shell for carrying the back pack. A first securing strap is attached to the front surface of the outer shell for retaining a hunting bow to the back pack. Finally, a cushioned flap hinged to a first edge of the front surface of the outer shell is employed for covering and protecting the hunting bow.

These and other objects and advantages of the present invention will become apparent from the following more detailed description, taken in conjunction with the accompanying drawings which illustrate the invention, by way of example.

BRIEF DESCRIPTION OF THE DRAWINGS

FIG. 4 is a third perspective view of the back pack of FIG. 1 showing the cushioned flap closed and releasably fastened to a plurality of mechanical clamps, and a bow pouch extending downward and partially removed from a storage space positioned within a double layer formed in the front surface of the back pack.

FIG. 5 is a partial cross-sectional view of the cushioned flap and the storage space of the back pack of FIG. 1 taken along the line 5—5 of FIG. 4 and showing the cushioned interior of the cushioned flap and the bow pouch positioned within the storage space.

DESCRIPTION OF THE INVENTION

Figure 1:
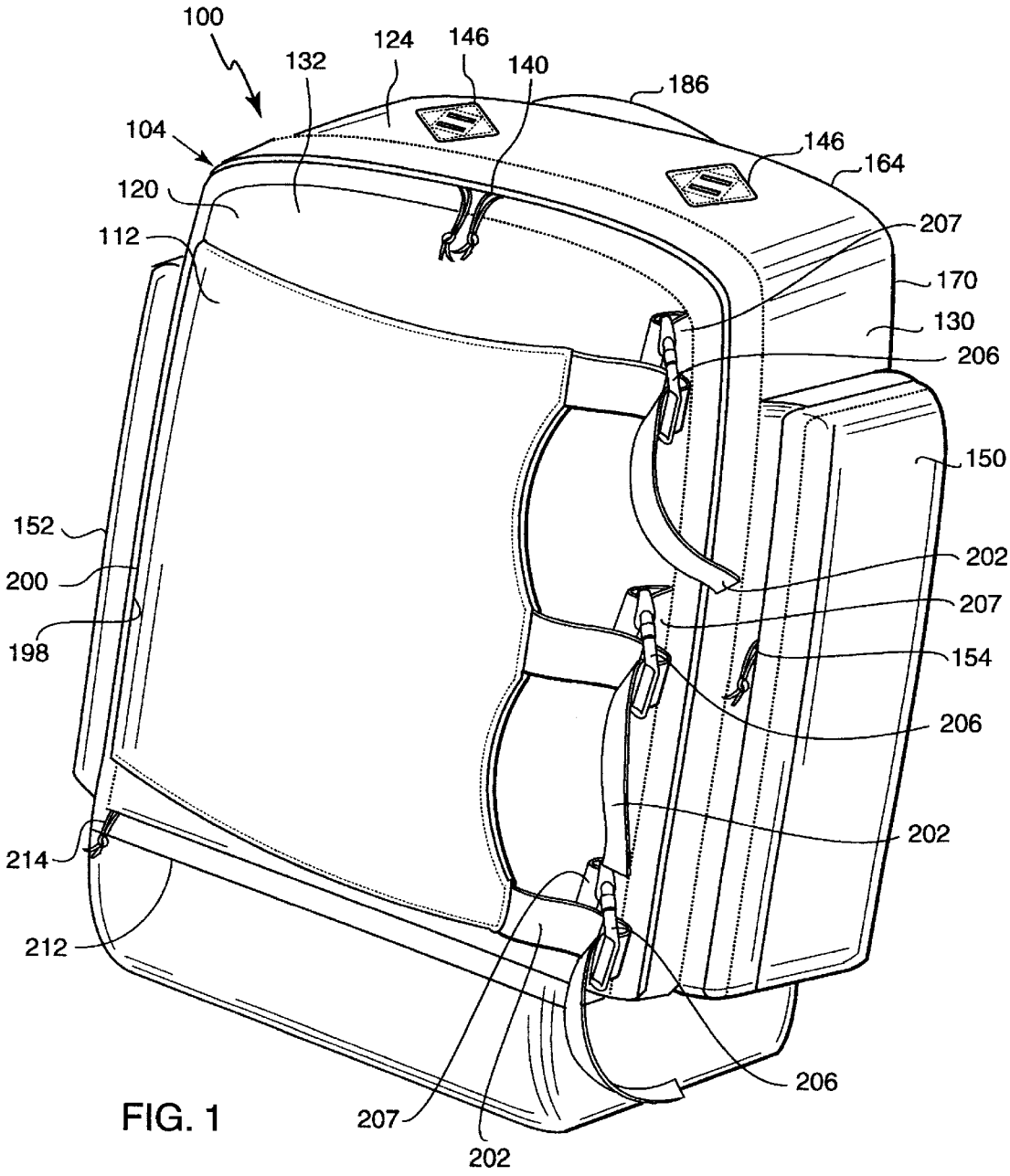
FIG. 1 is a first perspective view of a back pack for hunting bow and method of the present invention showing a generally rectangular spacious enclosure accessible via a plurality of zipper-type closures and having an additional cushioned flap permanently hinged to one side and releasably clamped to the other side of a front surface of the back pack.

The present invention is a back pack 100 for use with a hunting bow 102 having an outer shell 104 for forming a rectangular-shaped spacious enclosed compartment 106 in which hunting gear, provisions, clothing, first aid equipment and the like can be carried. The back pack 100 includes a pair of adjustable shoulder straps 108, 109 to facilitate carrying the back pack 100. At least a first securing strap 110 is attached to the outer shell 104 for retaining the hunting bow 102 to the back pack 100. A cushioned flap 112 is connected to the outer shell 104 in a manner that enables hinge-like motion by the cushioned flap 112. Thus, the cushioned flap 112 can be positioned over the hunting bow 102 for covering and protecting a sighting device (not shown) mounted on the hunting bow 102. A second securing strap 114 can also be included for increased retention of the hunting bow 102 to the back pack 100. A bow pouch 116 which connects to and extends downward from the outer shell 104 is employed to support a bottom end 118 of the hunting bow 102. The present invention is clearly illustrated in FIGS. 1–15 enclosed herewith.

Figure 2:
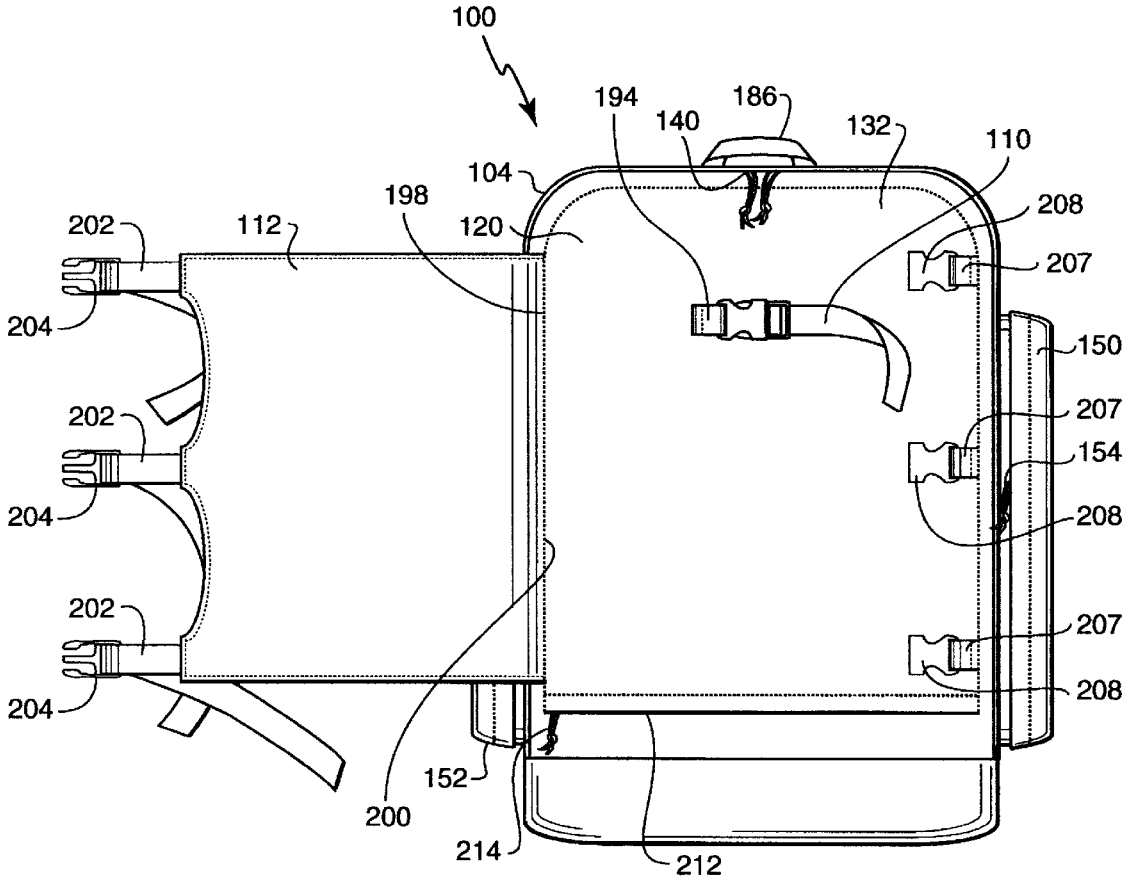
FIG. 2 is a first front elevational view of the back pack of FIG. 1 showing the cushioned flap opened and hinged to the left side with the front surface of the back pack exposed and showing a securing strap sewn to the front surface for holding the hunting bow in a stable position.
Figure 3:
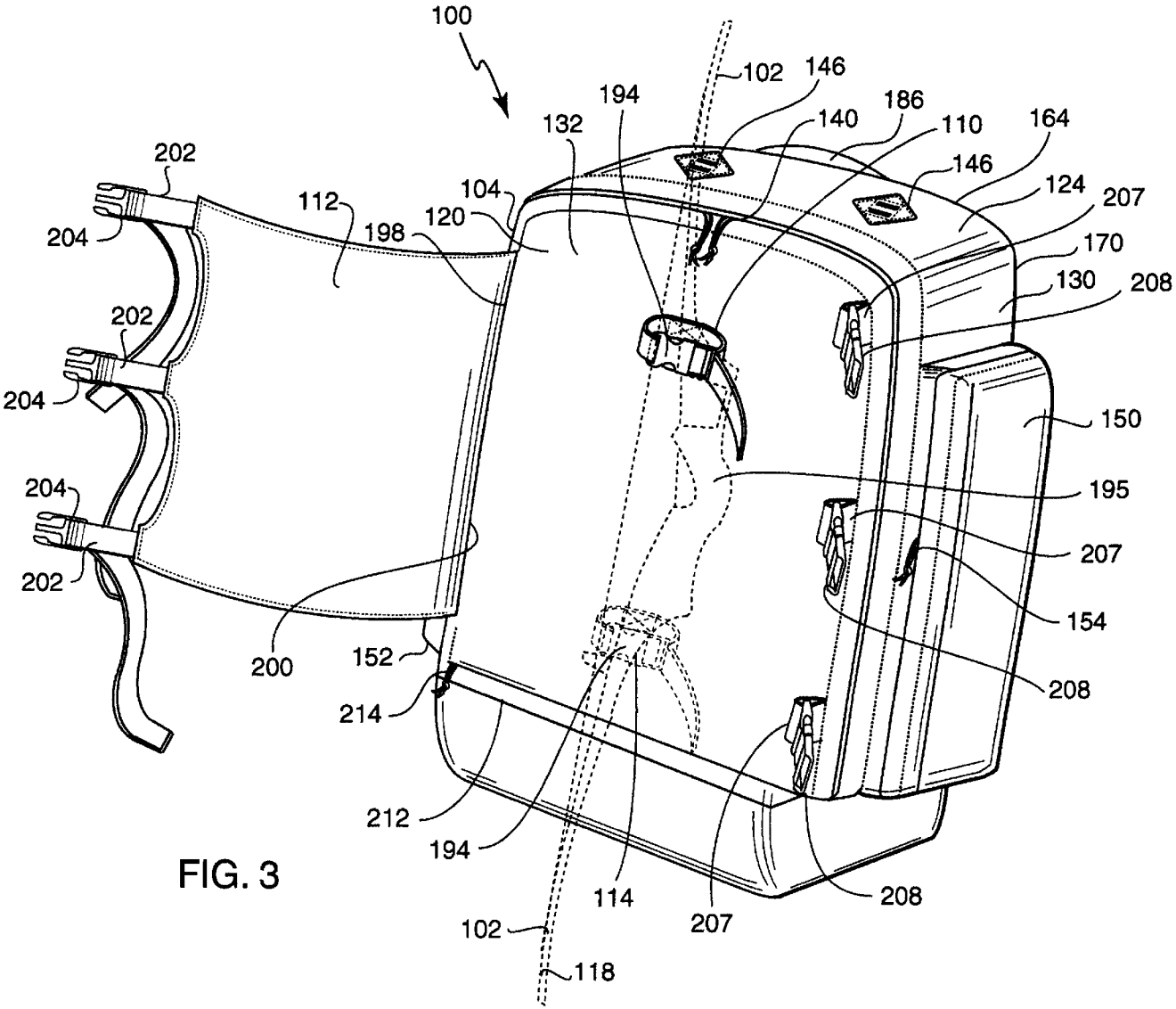
FIG. 3 is a second perspective view of the back pack of FIG. 1 showing the cushioned flap opened and hinged to the left side with the front surface of the back pack exposed and showing a pair of securing straps (lower securing strap in phantom) for holding a hunting bow (shown in phantom) in position, the cushioned flap subsequently being closed.

The outer shell 104 can exhibit any shape consistent with the function of the back pack 100 of the present invention. However, in the preferred embodiment, the outer shell 104 assumes a rectangular shape as is shown in FIGS. 1, 3 and 5. The outer shell 104 includes a front surface 120 best shown in FIGS. 2, 3, 6 and 7 and a rear surface 122 best shown in FIGS. 11 and 15. In addition, the outer shell 104 includes a top surface 124 (best shown in FIG. 12), a bottom surface 126 (best shown in FIG. 13), a right side 128 (best shown in FIG. 9), and a left side 130 (best shown in FIG. 10).

Figure 11:
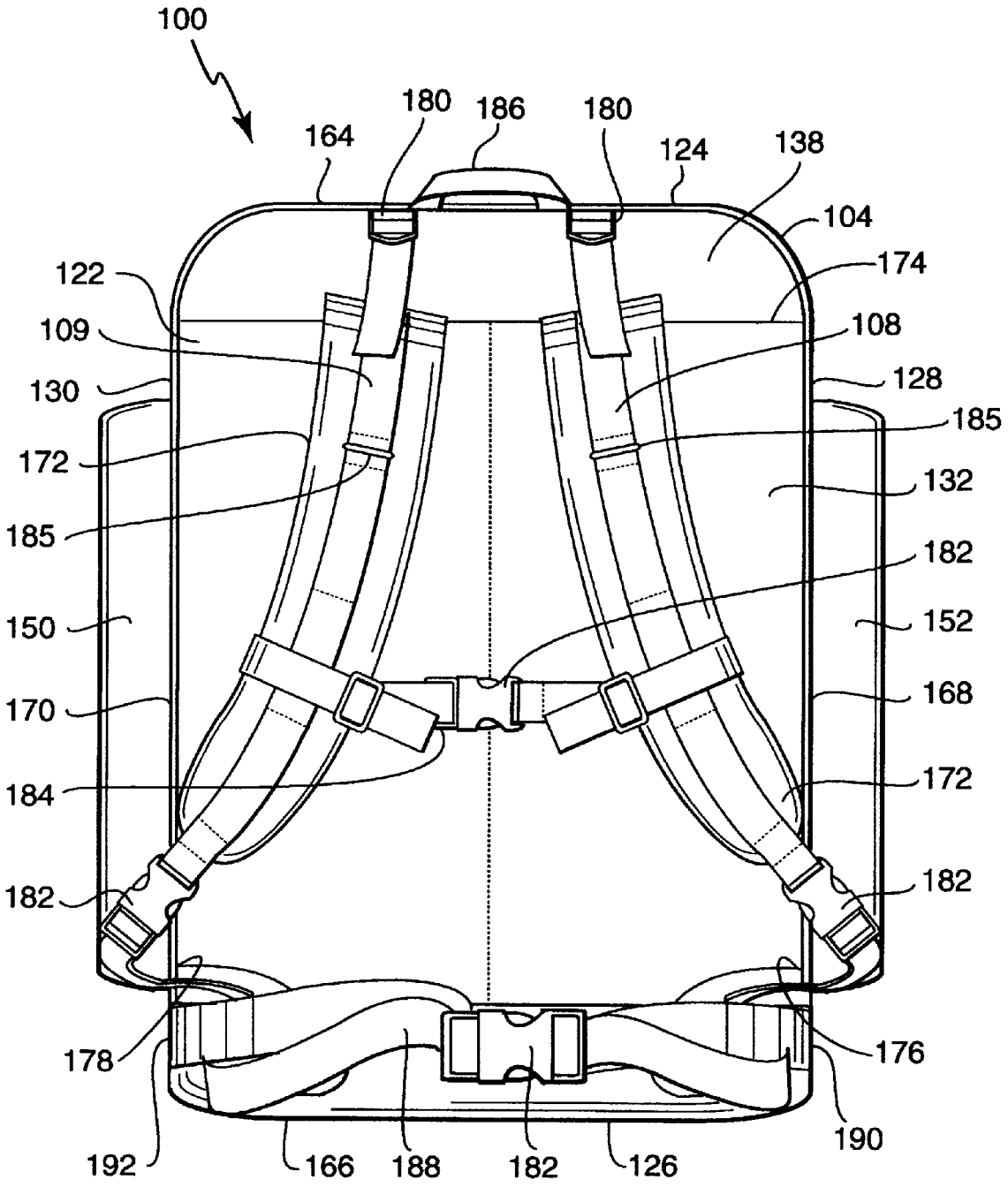
FIG. 11 is a rear elevational view of the back pack of FIG. 1 showing a rear surface having a pair of adjustable cushioned shoulder straps and a waist belt for carrying the back pack over the shoulders and back.
Figure 12:
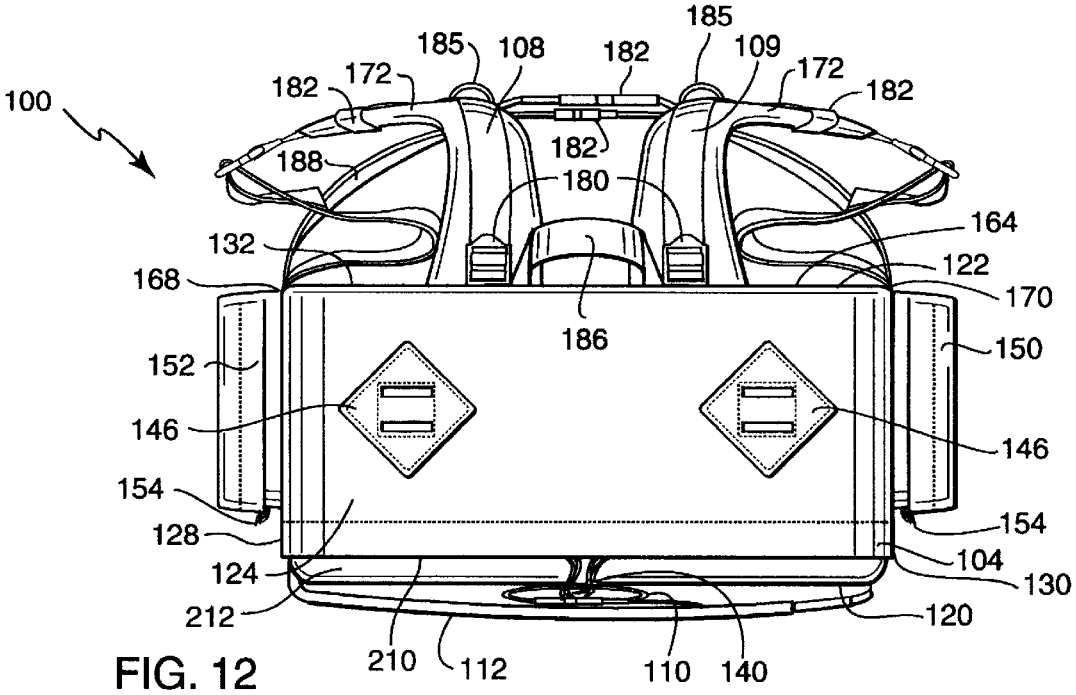
FIG. 12 is a top planar view of the back pack of FIG. 1 showing a carrying handle, the pair of adjustable cushioned shoulder straps and waist belt, the pair of side storage pockets, the securing strap positioned behind the cushioned flap, and a first pair of anchor loops sewn to the fabric of the top of the back pack for securing articles thereto.
Figure 13:
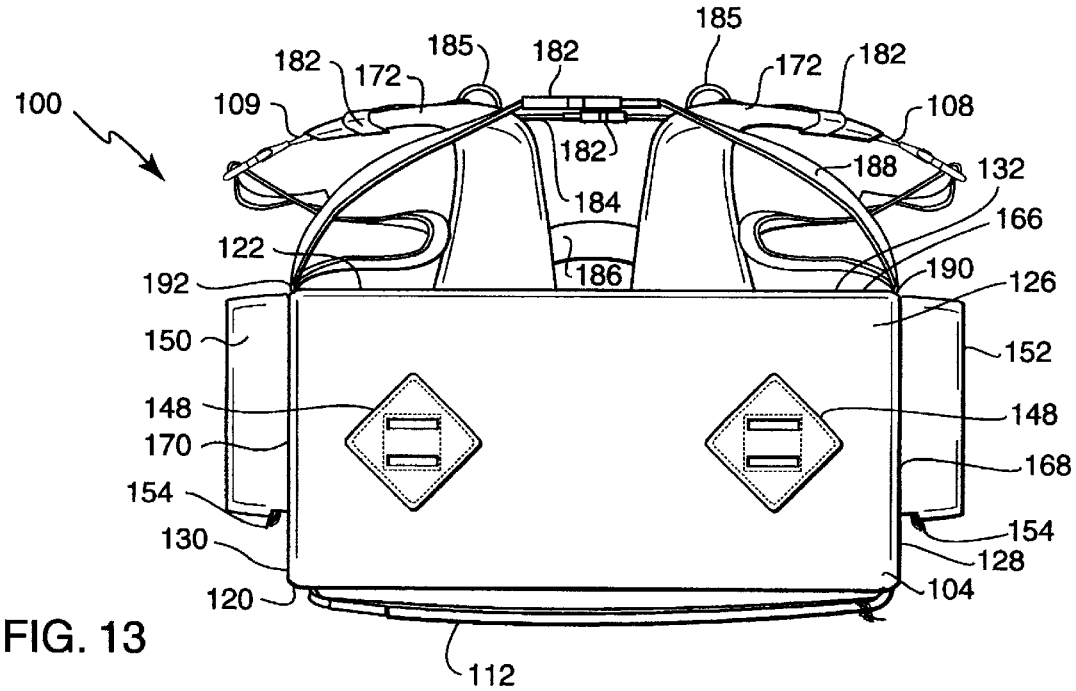
FIG. 13 is a bottom planar view of the back pack of FIG. 1 showing the pair of adjustable cushioned shoulder straps and waist belt, the pair of side storage pockets, the carrying handle, and a second pair of anchor loops sewn to the fabric of the bottom of the back pack for securing articles thereto.
Figure 15:
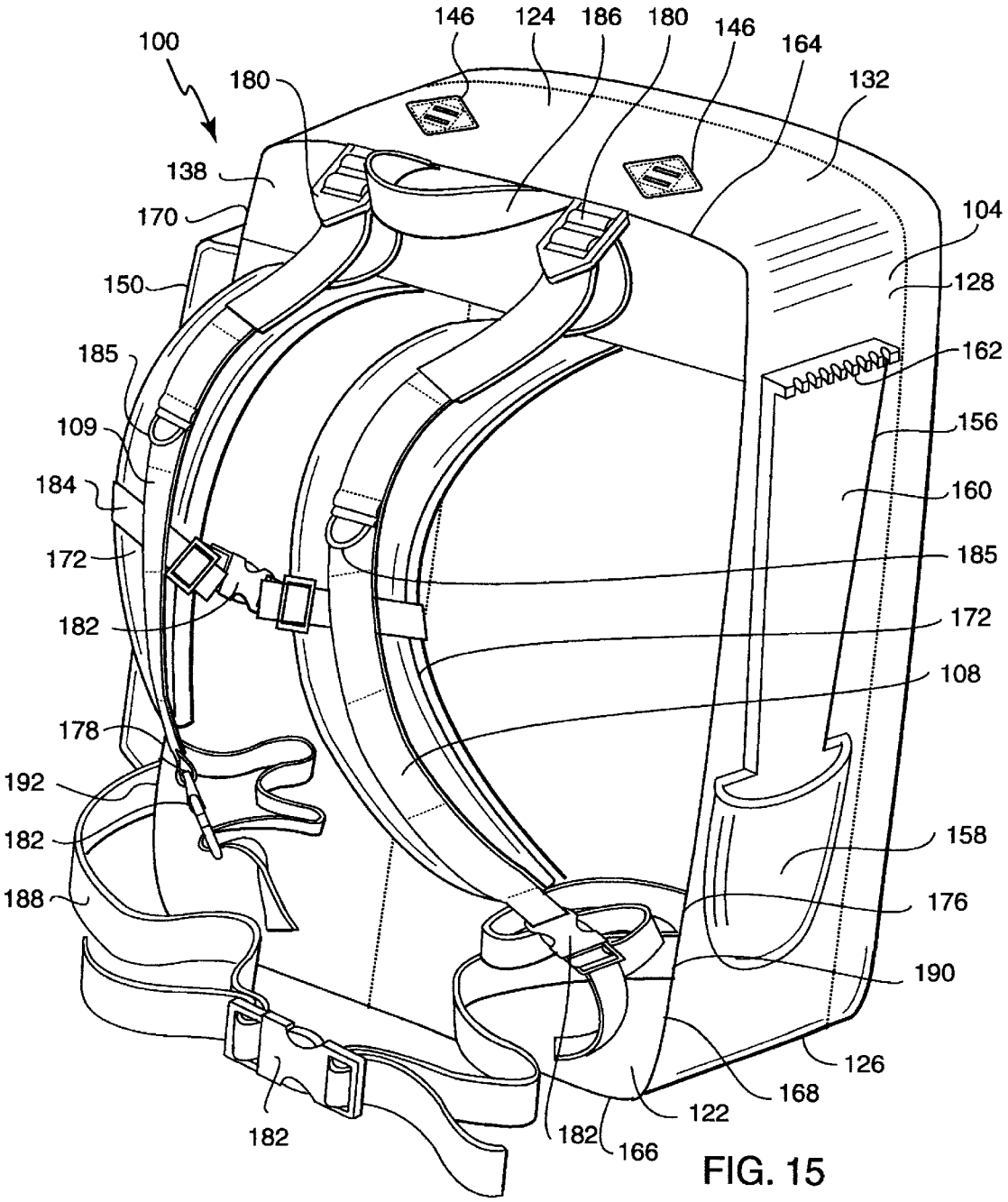
FIG. 15 is a seventh perspective view of the back pack of FIG. 1 showing a quiver for holding arrows for use with the hunting bow.

The construction of the outer shell 104 comprises two layers including an outer layer 132 formed of a rugged cotton fleece material and an inner layer 134 formed of a synthetic material such as, for example, nylon. Both the outer layer 132 and the inner layer 134 of the outer shell 104 are visible in the cross-sectional view of FIG. 5. The cotton fleece material muffles sound so as to reduce the likelihood of scaring off game when the back pack 100 is handled in the bush. The front surface 120, top surface 124, right side 128 and left side 130 each includes the outer layer 132 and the inner layer 134 as described hereinabove. The rear surface 122 includes an additional layer of sponge or foam rubber 136 between the outer layer 132 of fleece cotton and the inner layer 134 of nylon. The layer of sponge or foam rubber 136 serves to reduce the pressure on the hunters back from the loaded back pack 100. The bottom surface 126 of the outer shell 104 includes the inner layer 134 of nylon. However, the outer layer 132 of the bottom surface 126 is comprised of heavy duty leather (instead of the cotton fleece material) to withstand wear and tear. Likewise, an upper interface 138 located between the rear surface 122 and the top surface 124 is also comprised of leather to enhance the durability of the connection of the adjustable shoulder straps 108 and 109 to the rear surface 122 as is best shown in FIGS. 11 and 15.

Figure 14:
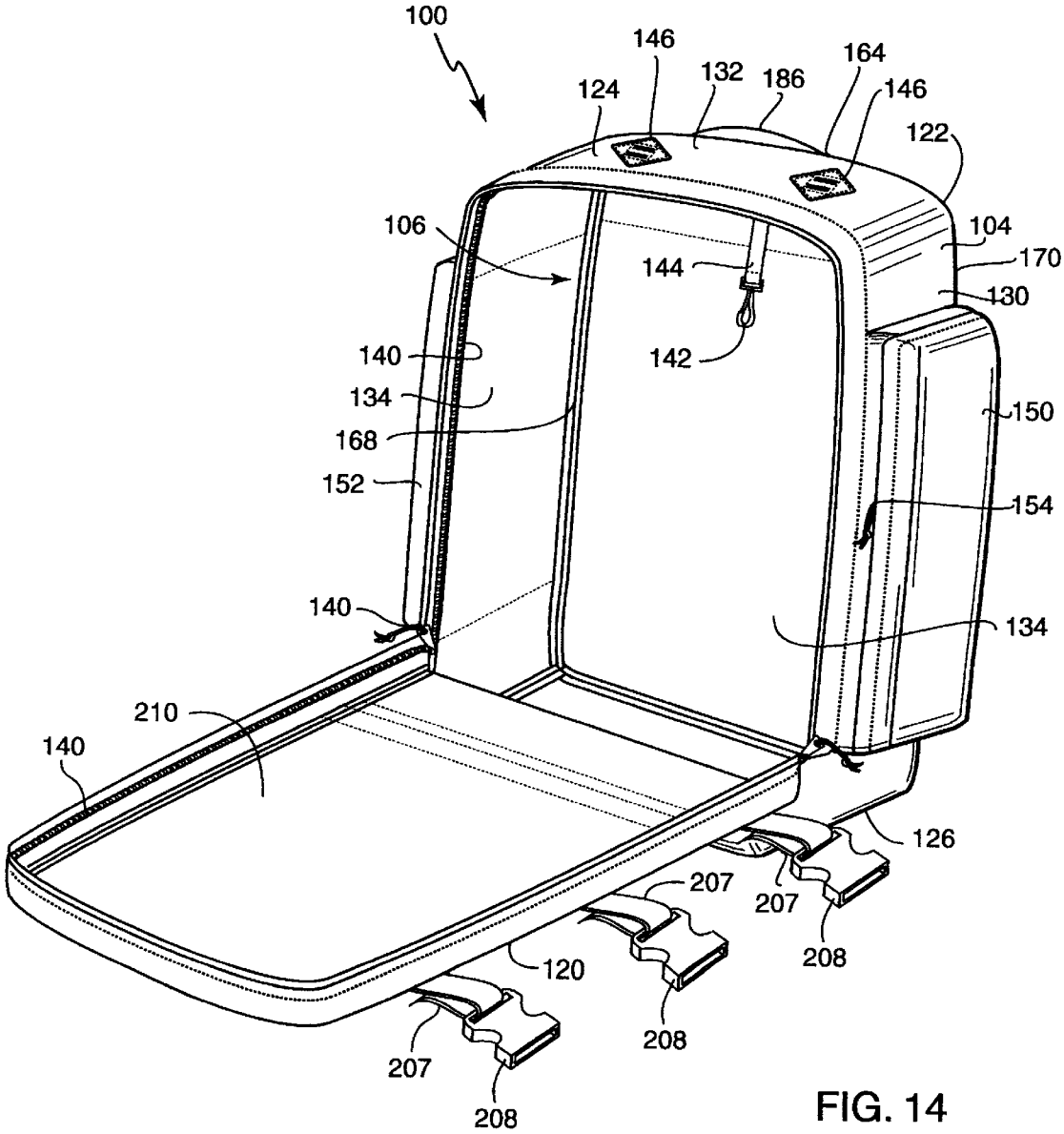
FIG. 14 is a sixth perspective view of the back pack of FIG. 1 showing the zipper-type closures disengaged so that the front surface of the back pack is positioned forward of the rear surface for exposing the interior space of the back pack and including a key clip sewn to the inside fabric of the back pack.

The front surface 120 engages the top surface 124 and both the right side 128 and the left side 130 of the outer shell 104 with a mechanical closure 140. The mechanical closure 140 can be, for example, a heavy duty zipper closure. The heavy duty zipper closure 140 is well known in the art and provides access to the enclosed compartment 106 as is seen by comparing FIGS. 1 and 14. When the zipper closure 140 is closed, i.e., the front surface 120 is engaged with the top surface 124, the right side 128 and the left side 130, the interior of the enclosed compartment 106 is inaccessible as is shown in FIG. 1. However, when the zipper closure 140 is disengaged from the top surface 120, the right side 128 and the left side 130, the interior of the enclosed compartment 106 is accessible as is shown in FIG. 14. Thereafter, hunting gear, provisions, clothing and other equipment can be inserted into or removed from the outer shell 104. Additionally, access to a key clip 142 suspended from a short piece of web material 144 sewn to the upper interface 138 from inside the enclosed compartment 106 exists.

Located on the top surface 124 of the outer shell 104 is a first pair of anchor loops 146 best shown in FIGS. 1, 3, 4 and 12. Likewise, located on the bottom surface 126 is a second pair of anchor loops 148 best shown in FIG. 13. Each of the pairs of first and second anchor loops 146 and 148, respectively, are comprised of a plastic material and are sewn to the material of the outer shell 104. Each of the anchor loops 146 and 148 includes a construction to accommodate the attachment of, for example, a web strap (not shown). The web strap (not shown) in combination with the anchor loops 146 and 148 function as a means to lash miscellaneous articles (such as a blanket, tarp, sleeping mat, etc.) to either the top surface 124 or the bottom surface 126 of the outer shell 104. Thus, the anchor loops 146 and 148 serve to increase the capacity to carry hunting and camping gear with the back pack 100.

The outer shell 104 also includes at least a first side storage pocket 150 attached to the outer shell 104 as by sewing. The storage pocket 150 would typically be used to stow hunting gear, trail food and water, a first aid kit and the like. The storage pocket 150 would normally be attached to the left side 130 of the outer shell 104 as is shown in FIG. 1. However, the preferred embodiment of the present invention includes a second side storage pocket 152 attached to the right side 128 of the outer shell 104. The pair of side storage pockets 150 and 152 are identical and are sewn to the outer cotton fleece material 132 of the outer shell 104 as is best shown in FIGS. 1, 9, 10 and 11. Likewise, the inner layer 134 is comprised of a synthetic such as nylon as in other portions of the back pack 100. Each of the storage pockets 150 and 152 includes a small mechanical zipper-type closure 154 for closing and obtaining access to the interior thereof. The mechanical zipper-type closures 154 are positioned so as to be adjacent to the heavy-duty zipper-type closure 140 as is shown in FIGS. 1 and 2.

In the case where the side storage pocket 150 is affixed to the left side 130 of the outer shell 104 (and the side storage pocket 152 does not exist), the right side 128 of the outer shell 104 can include a quiver 156 as is shown in FIG. 15. The quiver 156 serves as a reservoir for arrows and can be comprised of a heavy duty plastic, leather or other suitable material. The quiver 156 includes a lower receptacle 158 for holding the sharpened end of the arrows (not shown) and an upper board portion 160 having a plurality of individual registers 162 for separating and maintaining alignment of the individual arrows (not shown). The quiver 156 is affixed to the right side 128 of the outer shell 104 by any suitable manner such as by heavy-duty sewing, use of mechanical fasteners, adhesives or the like. Thus, the addition of the quiver 156 to the right side 128 of the outer shell 104 provides a further repository for hunting arrows in addition to any mechanical device (not shown) that is affixed or clamped to the hunting bow 102.

The rear surface 122 of the outer shell 104 communicates with the top surface 124 at a seam 164, the bottom surface 126 at a seam 166, the right side 128 at a seam 168, and the left side 130 at a seam 170 as is best shown in FIGS. 11 and 15. The adjustable shoulder straps 108 and 109 include padding 172 as is best shown in FIG. 11. The padding 172 attached to the shoulder straps 108 and 109 helps to cushion the loaded back pack 100 on the hunter's spine and back after several hours hiking in the bush. The tops of the shoulder straps 108 and 109 are sewn into the seam 164 at the interface of the rear surface 122 with the top surface 124. However, the padding 172 is sewn into a seam 174 located at the interface of the rear surface 122 with the upper interface 138 shown in FIG. 11. The bottom of the padding 172 attached to the shoulder strap 108 is sewn to the shoulder strap 108. Likewise, the bottom of the padding 172 attached to the shoulder strap 109 is sewn to the shoulder strap 109. The bottom of the shoulder strap 108 is sewn into the seam 168 located at the interface of the rear surface 122 with the right side 128 at a point 176 shown best in FIG. 9. Likewise, the bottom of the shoulder strap 109 is sewn into the seam 170 located at the interface of the rear surface 122 with the left side 130 at a point 178 shown best in FIG. 10.

The adjustable shoulder straps 108 and 109 each include an adjustable buckle 180 located at the seam 164 which is the interface between the rear surface 122 and the top surface 124 best shown in FIG. 11. Additionally, the adjustable shoulder straps 108 and 109 each include a plastic quick release fastener 182 to separate the shoulder straps 108 and 109 midway through their lengths, respectively. Further, a cross strap 184 is employed to connect the shoulder strap 108 with the shoulder strap 109 to more securely attach the back pack 100 to the back of the hunter. The cross strap 184 also includes a plastic quick release fastener 182 for rapid release as is shown in FIG. 11. Each of the adjustable shoulder straps 108 and 109 also includes a ring 185 sewn onto the respective shoulder strap 108 and 109 as shown in FIG. 11. The ring 185 provides a convenient location for attaching an article, as by lashing, to the respective shoulder straps 108 and 109.

In addition to the adjustable shoulder straps 108 and 109, a carrying handle 186 comprised of web belt material is sewn into the seam 164 (i.e., between the rear surface 122 and the top surface 124) as is best shown in FIGS. 11 and 15. Finally, an adjustable waist belt 188 also comprised of web belt material is sewn to the outer shell 104 at seam 168 (i.e., the interface between the rear surface 122 and the right side 128) at a point 190, and at seam 170 (i.e., the interface between the rear surface 122 and the left side 130) at a point 192 best shown in FIGS. 11 and 15. The waist belt 188 includes a plastic quick release fastener 182 for a rapid release of the waist belt 188 from around the waist of the hunter. It is noted that although not shown in the drawing FIGS. accompanying this patent disclosure, an additional flat compartment could be formed on or within the rear surface 122. This additional flat compartment could include a mechanical zipper-type closure and be utilized for carrying clothing items.

Figure 6:
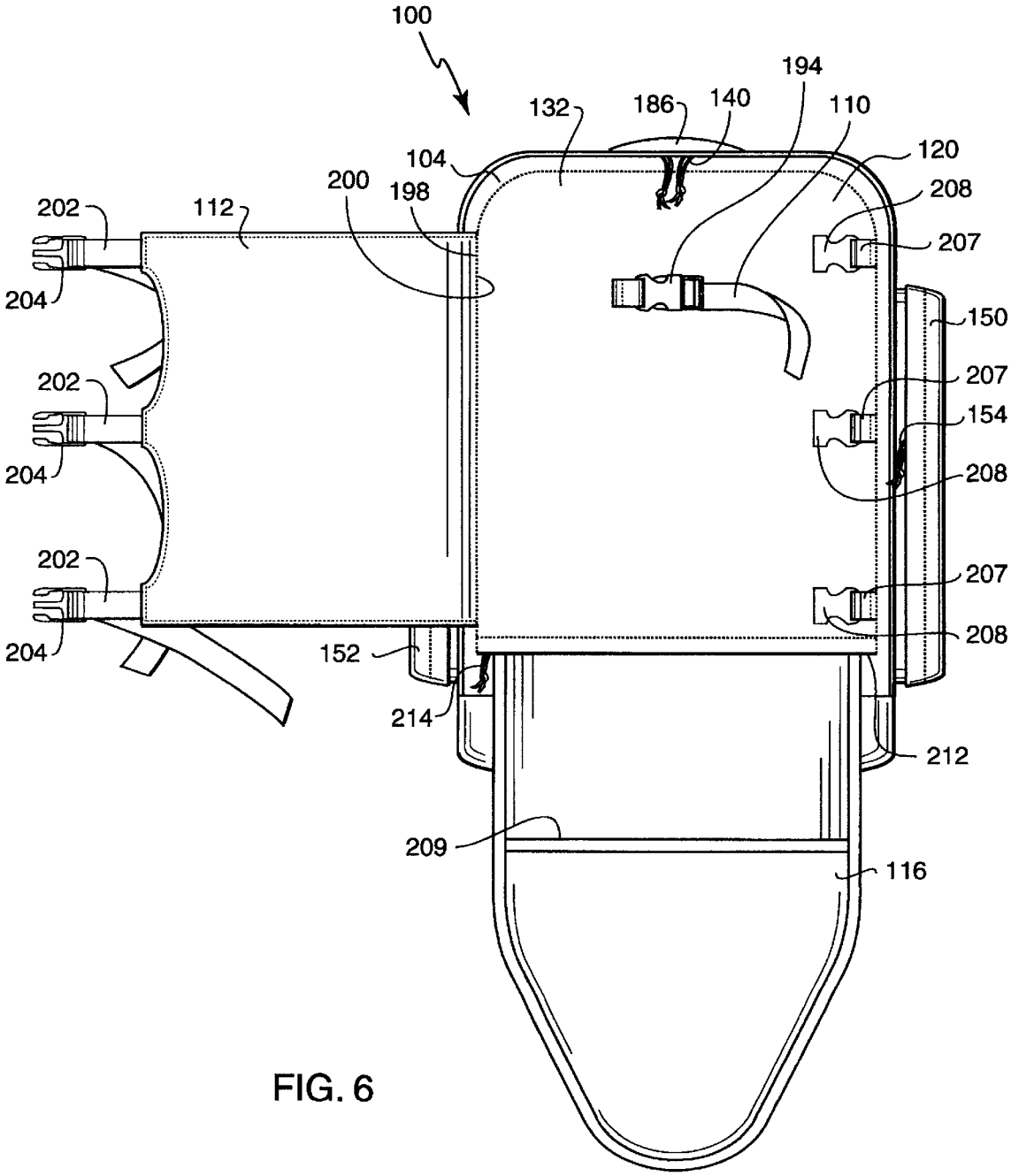
FIG. 6 is a second front elevational view of the back pack of FIG. 1 showing the cushioned flap opened and hinged to the left side with the front surface of the back pack exposed, a single securing strap, and the bow pouch extending downward and removed from the storage space.
Figure 7:
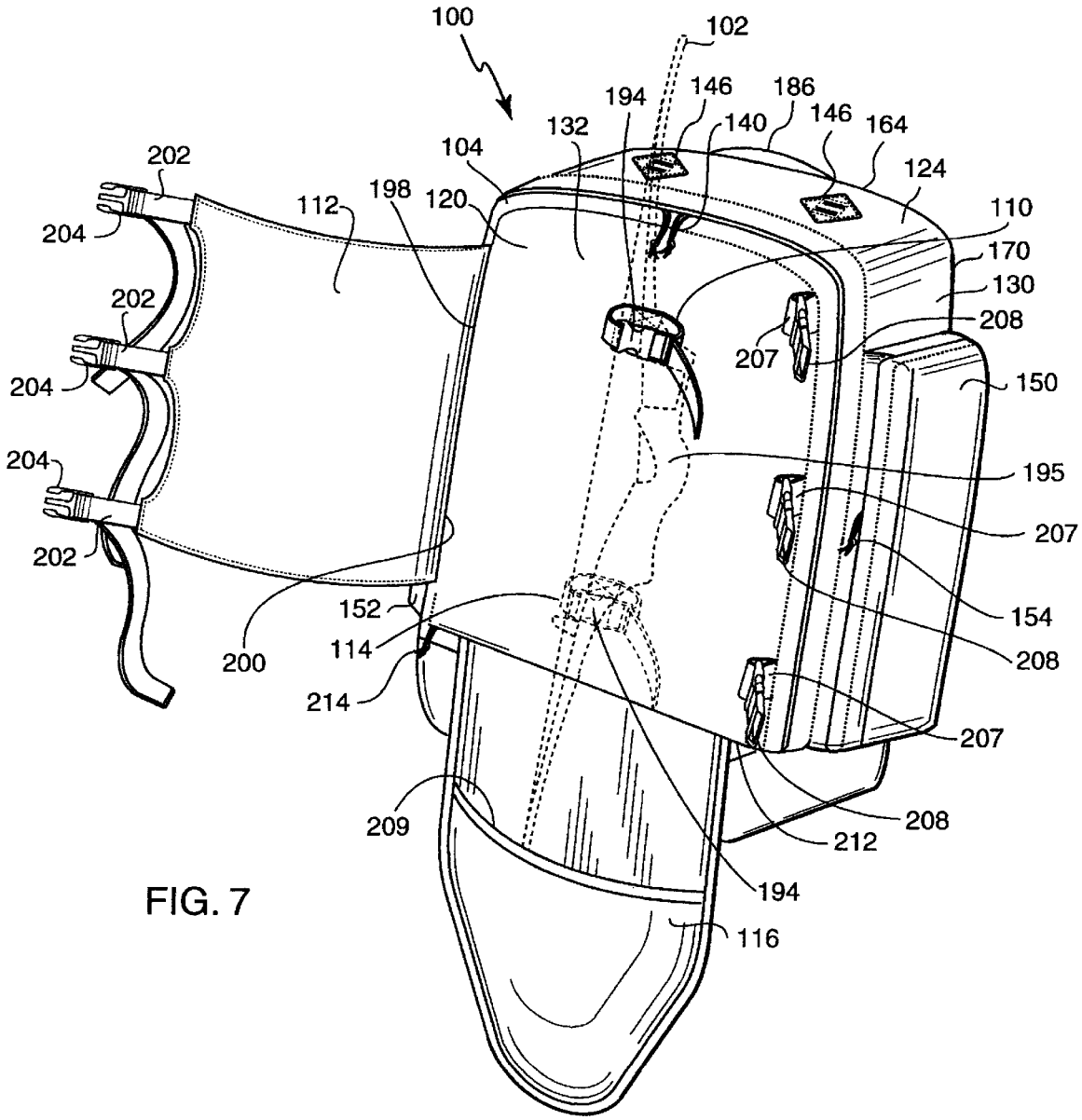
FIG. 7 is a fourth perspective view of the back pack of FIG. 1 showing the cushioned flap opened and hinged to the left side, the bow pouch extending downward, and a hunting bow (shown in phantom) having one end seated within the bow pouch and at least one securing strap holding the other end of the hunting bow in position.

One of the many novel feathers of the present invention is that the back pack 100 is designed to be used in conjunction with a hunting bow 102 as is illustrated in FIGS. 3, 6, 7 and 8. Thus, in the marketplace, the back pack 100 is referred to as a "bow pack". The components that enable the hunting bow to be physically attached to the back pack 100 include the first securing strap 110, second securing strap 114, cushioned flap 112 and the bow pouch 116, each of which are clearly shown in FIG. 7. The first securing strap 110 is comprised of web belt material and is sewn to the upper front surface 120 of the outer shell 104 as is shown best in FIGS. 2 and 6. The second securing strap 114 (when fitted) is also comprised of web belt material and is sewn to the lower front surface 120 as shown in FIGS. 3 and 7. Both the first securing strap 110 and the second securing strap 114 include a plastic quick release fastener 194 on one end thereof to conveniently disconnect the two ends of the respective securing straps 110, 114 one from the another.

Figure 8:
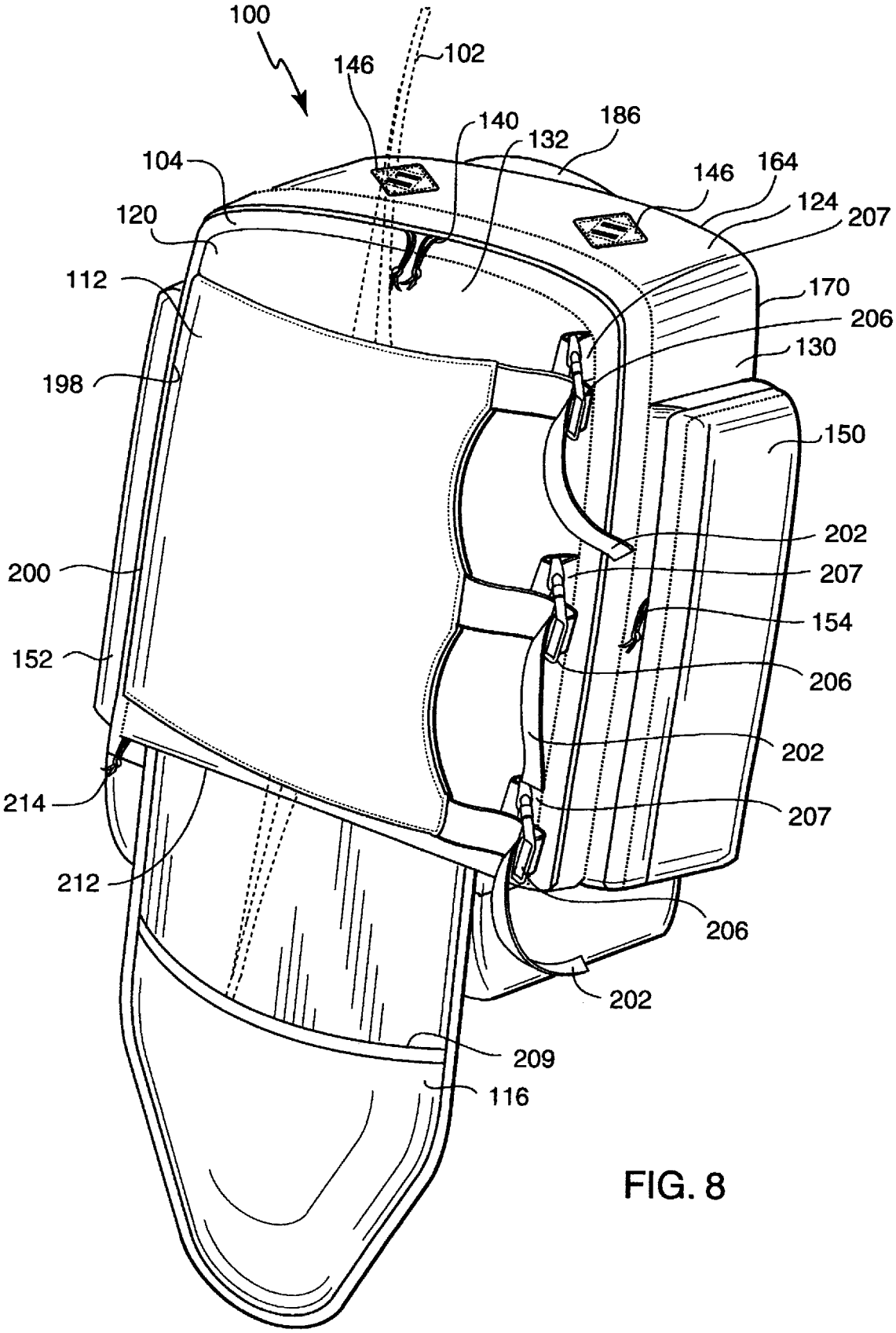
FIG. 8 is a fifth perspective view of the back pack of FIG. 1 showing the cushioned flap closed and secured, the bow pouch extending downward, and the hunting bow (shown in phantom) having one end seated within the bow pouch and the other end extending above the back pack.
Figure 9:
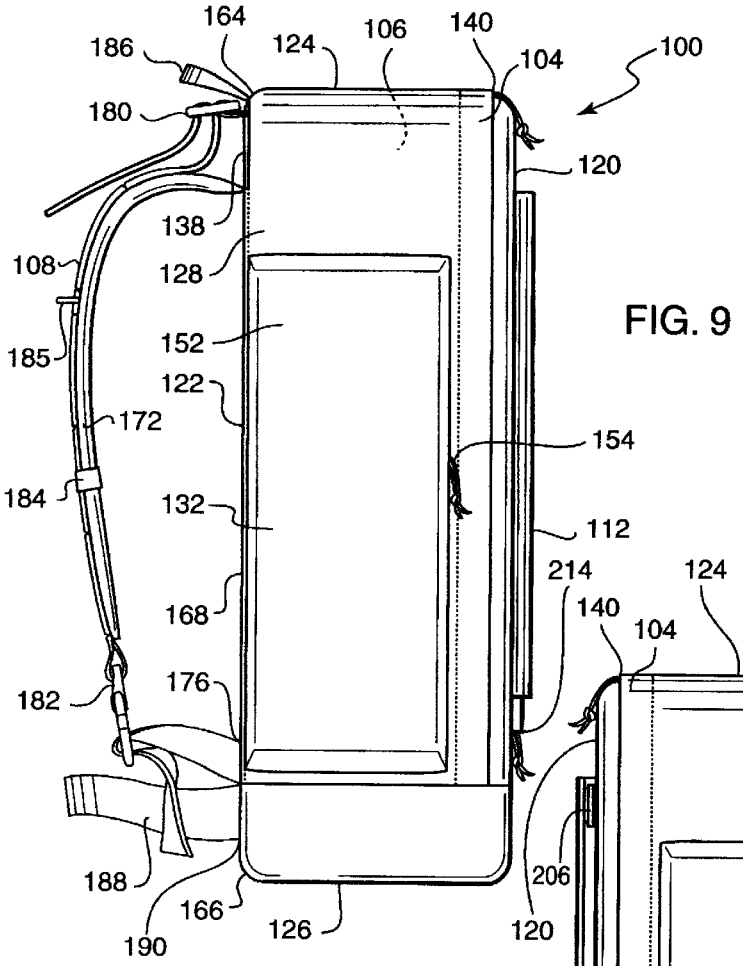
FIG. 9 is a right side elevational view of the back pack of FIG. 1 showing a side storage pocket having a zipper-type closure for stowing gear.
Figure 10:
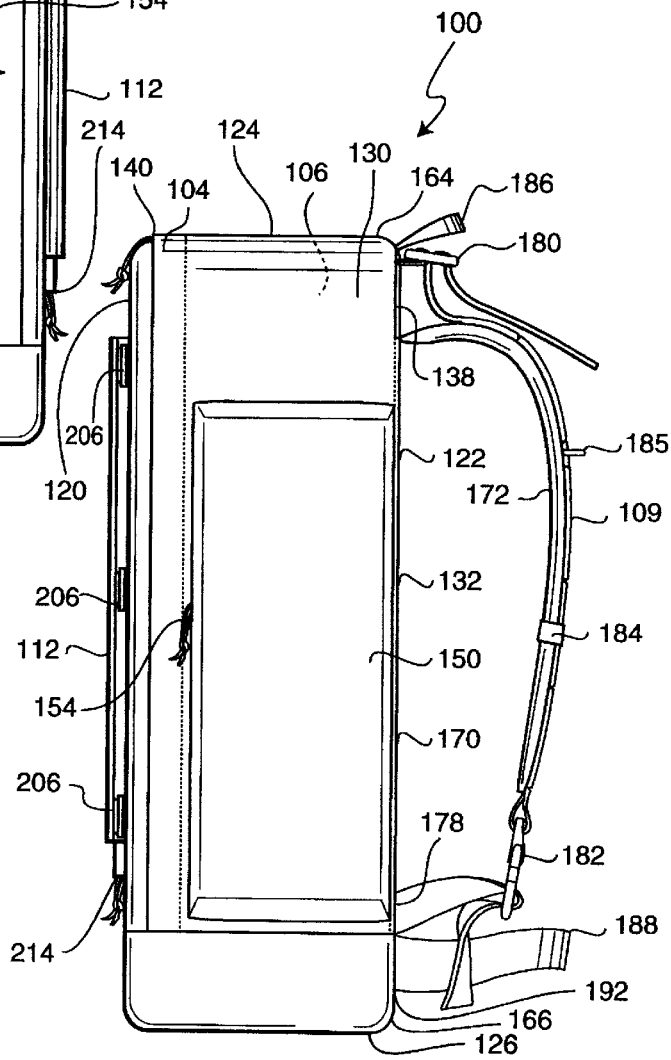
FIG. 10 is a left side elevational view of the back pack of FIG. 1 showing a side storage pocket having a zipper-type closure for stowing gear.

The hunting bow 102 (with the synthetic bow string tensioned) is then positioned so that the first securing strap 110 can be wrapped about the body 195 (shown in phantom) of the hunting bow 102 as shown in FIG. 3. The first securing strap 110 is then adjusted so that it is securely wrapped about the body 195 (shown in phantom) of the hunting bow 102. The first securing strap 110 is oriented so that the hunting bow 102 is retained to the back pack 100 in a vertical position with respect to the back pack 100. The cushioned flap 112 also shown in FIG. 3 is then employed to hold the hunting bow 102 in position in conjunction with the first securing strap 110. The cushioned flap 112 is comprised of outer and inner layers 132 of cotton fleece material with a layer of sponge or foam 196 positioned there between as shown in FIG. 5. In the preferred embodiment, a front left vertical edge 198 of the cushioned flap 112 is sewn to the front surface 120 of the outer shell 104 at a seam 200 as shown in FIGS. 2 and 3. This feature enables the cushioned flap 112 to hinge from an open position as shown in FIGS. 2 and 3 to a closed position as shown in FIGS. 4 and 8. Thus, the cushioned flap 112 hinged to the front left vertical edge 198 of the front surface 120 can be seen as partially covering the hunting bow 102 for providing protection thereto. This is clearly shown in FIGS. 3, 7 and 8 since the hunting bow 102 extends above and below the cushioned flap 112.

Thus, when the hunting bow 102 is held in vertical position by the first securing strap 110, the cushioned flap 112 can be rotated about the seam 200 so as to partially cover and protect the hunting bow 102 (and in particular a sighting device, not shown, that is typically fitted onto high quality hunting bows). It is the sponge or foam layer 196 positioned within the cushioned flap 112 shown in FIG. 5 that protects the hunting bow 102. The cushioned flap 112 includes a plurality of straps 202 (typically three) comprised of web belt material. Attached to the end of each of the straps 202 is a male portion 204 of a corresponding number of plastic quick release fasteners 206 as shown in FIGS. 1 and 2. Sewn to the front surface 120 of the outer shell 104 by web material pieces 207 is a corresponding plurality of female portions 208 of the quick release fasteners 206. Thus, the cushioned flap 112 can be held in position over the first securing strap 110 and the hunting bow 102 by engaging the male portions 204 with the female portions 208 of the quick release fasteners 206.

When fitted to the lower portion of the front surface 120, the web material of the second securing strap 114 can also be wrapped about the body 195 (shown in phantom) of the hunting bow 102 as shown in FIG. 3. The second securing strap 114 is then adjusted so that it is securely wrapped about the body 195 (shown in phantom) of the hunting bow 102. The second securing strap 114 is oriented so that the hunting bow 102 is retained to the back pack 100 in a vertical position with respect to the back pack 100. The second securing strap 114 also includes one of the plastic quick release fasteners 194 shown in FIG. 3. Thereafter, the cushioned flap 112 shown in FIG. 3 is employed to hold the hunting bow 102 in position in conjunction with the first securing strap 110 and the second securing strap 114 in the same manner as described above. The cushioned flap 112 is sewn to the seam 200 as shown in FIG. 2. This construction results in the cushioned flap 112 rotating about the seam 200 from left-to-right as shown in FIG. 2. This construction is most suitable for partially covering and protecting hunting bows 102 that include a right-handed sighting device. However, it should be noted that the cushioned flap 112 could be attached to the opposite side of the front surface 120 compared to that shown in FIG. 2 in the case of a left-handed sighting device. This alternative construction would result in the cushioned flap rotating from right-to-left as viewed in FIGS. 2 and 3.

The bow pouch 116 is an additional feature of the present invention which can be used in conjunction with the first securing strap 110 and the second securing strap 114 to attach the hunting bow 102 to the back pack 100. The bow pouch 116 is connected to and extends downward from the outer shell 104 as is shown in FIGS. 6, 7 and 8. The bow pouch 116 is comprised of an outer layer 132 of cotton fleece as is shown in the cross-sectional view of FIG. 5. The inside layer 134 of the bow pouch 116 is comprised of a synthetic material such as nylon to provide easy entry and exit of the bottom end 118 of the hunting bow 102 into and out of a pocket 209 as is clearly shown in FIGS. 7 and 8. The outer layer 132 of the bow pouch 116 is actually sewn to a forward wall 210 of the enclosed compartment 106 as is shown in FIG. 5. The forward wall 210 is comprised of the same synthetic material as the inner layer 134.

When in use, the bow pouch 116 is extended downward as is shown in FIGS. 6, 7 and 8. The bottom end 118 of the hunting bow 102 is inserted into the pocket 209 of the bow pouch 116 for support as is shown in FIGS. 7 and 8. Thereafter, the body 195 of the hunting bow 102 is captured and affixed to one or both of the first securing strap 110 and the second securing strap 114. The quick release fastener 194 of the securing straps 110, 114 are then adjusted to the proper tension. Finally, the cushioned flap 112 is rotated about the seam 200 from left-to-right and the quick release fasteners 206 are connected. Thereafter, the hunting bow 102 is covered and protected as previously described above.

When only the securing straps 110, 114 are utilized, the bow pouch 116 and pocket 109 are not employed to support the bottom end 118 of the hunting bow 102. Under these conditions, the bow pouch 116 must be stowed away so as not to interfere with the normal use of the back pack 100. A storage space 212 for the bow pouch 116 is formed between the inside layer 134 of the front surface 120 of the outer shell 104 and the forward wall 210 of the enclosed compartment 106 as is shown in FIG. 5. Both the inside layer 134 of the front surface 120 and the forward wall 210 of the enclosed compartment 106 are fashioned from the synthetic material such as nylon. The storage space 212 is accessible through a mechanical zipper-type closure 214 as is shown in FIGS. 1–4 and 6–9. When the zipper-type closure 214 is open, the bow pouch 116 can be withdrawn as is shown in FIGS. 4, 6, 7 and 8. The bow pouch 116 is best shown partially withdrawn or partially inserted in FIG. 4. However, once the bow pouch 116 is inserted into the storage space 212, the zipper-type closure 214 shown in FIG. 1 can be closed by pulling it to the right side.

The present invention provides novel advantages over other back packs known in the prior art. A main advantage of the back pack 100 of the present invention is that it is utilized specifically with a hunting bow 102, includes a first securing strap 110 and a second securing strap 114 each affixed to the outer shell 104 for attaching the hunting bow 102 to the back pack 100, a bow pouch 116 extending downward from said outer shell 104 for supporting a bottom end 118 of the hunting bow 102, a cushioned flap 112 hinged to the outer shell 104 for covering and protecting the hunting bow 102, a storage space 212 for stowing the bow pouch 116 when not in use, and where the outer shell 104 forms a spacious enclosed compartment 106 that is accessible via a mechanical zipper-type closure 140, and has adjustable padded shoulder straps 108, 109 for carrying the back pack 100.

While the present invention is described herein with reference to illustrative embodiments for particular applications, it should be understood that the invention is not limited thereto. Those having ordinary skill in the art and access to the teachings provided herein will recognize additional modifications, applications and embodiments within the scope thereof and additional fields in which the present invention would be of significant utility.

It is therefore intended by the appended claims to cover any and all such modifications, applications and embodiments within the scope of the present invention. Accordingly,

What is claimed is:

1. A back pack for use with a hunting bow comprising:

an outer shell having a front surface and a rear surface for forming an enclosed compartment, said enclosed compartment being accessible;

a pair of shoulder straps attached to said rear surface of said outer shell for carrying said back pack;

a first securing strap attached to said front surface of said outer shell, said first securing strap being oriented for retaining a hunting bow to said back pack in a vertical position with respect to said back pack; and a cushioned flap hinged to a first vertical edge of said front surface of said outer shell for partially covering and protecting said hunting bow, said hunting bow extending above and below said cushioned flap.

2. The back pack of claim 1 wherein said outer shell is rectangular in shape.

3. The back pack of claim 1 wherein said outer shell and said cushioned flap each comprise cotton fleece material for muffling noise during use.

4. The back pack of claim 1 further including a mechanical closure attached to said outer shell for providing access to said enclosed compartment.

5. The back pack of claim 4 wherein said mechanical closure comprises a zipper-type closure.

6. The back pack of claim 1 wherein said pair of shoulder straps is adjustable.

7. The back pack of claim 1 further including an adjustable waist belt for securely holding said back pack in position.

8. The back pack of claim 1 further including a carrying handle.

9. The back pack of claim 1 wherein said first securing strap is comprised of a web belt and is sewn to said front surface of said outer shell.

10. The back pack of claim 1 further including a second securing strap attached to said front surface of said outer shell, said second securing strap being oriented for retaining said hunting bow to said back pack in a vertical position with respect to said back pack.

11. The back pack of claim 1 wherein said cushioned flap includes a foam layer.

12. The back pack of claim 1 wherein said cushioned flap is releasably fastened to said front surface of said outer shell by at least one quick release fastener.

13. The back pack of claim 1 further including at least one side storage pocket attached to said outer shell.

14. The back pack of claim 1 further including a quiver attached to said outer shell for storing arrows.

15. The back pack of claim 1 further including a plurality of anchor loops attached to said outer shell for tying articles thereto.

16. The back pack of claim 1 further including a key clip attached to an interior surface of said outer shell for securing keys thereto.

17. A back pack for use with a hunting bow comprising:

an outer shell having a front surface and a rear surface for forming an enclosed compartment;

a mechanical closure attached to said outer shell for providing access to said enclosed compartment;

a pair of shoulder straps attached to said rear surface of said outer shell for carrying said back pack;

a first securing strap and a second securing strap each attached to said front surface of said outer shell, said first securing strap and said second securing strap each being oriented for retaining a hunting bow to said back pack in a vertical position with respect to said back pack; and a cushioned flap hinged to a first vertical edge of said front surface of said outer shell for partially covering and protecting said hunting bow, said hunting bow extending above and below said cushioned flap.

18. A back pack for use with a hunting bow comprising:

an outer shell having a front surface and a rear surface for forming an enclosed compartment, said enclosed compartment being accessible;

a pair of shoulder straps attached to said rear surface of said outer shell for carrying said back pack;

a first securing strap attached to said front surface of said outer shell for retaining a hunting bow to said back pack;

a cushioned flap hinged to a first edge of said front surface of said outer shell for covering and protecting said hunting bow; and a bow pouch connected to and extending downward from said outer shell for supporting a bottom end of said hunting bow.

19. The back pack of claim 18 further including a mechanical closure attached to said outer shell for providing access to said enclosed compartment.

20. The back pack of claim 18 further including a storage space located between said front surface and said enclosed compartment of said outer shell for storing said bow pouch when not in use.

* * * * *